US008073367B2

(12) United States Patent
Hayashi

(10) Patent No.: US 8,073,367 B2
(45) Date of Patent: Dec. 6, 2011

(54) TONER CARTRIDGE AND IMAGE FORMING APPARATUS USING THE SAME

(75) Inventor: Shigeki Hayashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 170 days.

(21) Appl. No.: 12/539,668

(22) Filed: Aug. 12, 2009

(65) Prior Publication Data

US 2010/0061772 A1 Mar. 11, 2010

(30) Foreign Application Priority Data

Sep. 9, 2008 (JP) ..... 2008-231120

(51) Int. Cl.
*G03G 15/08* (2006.01)

(52) U.S. Cl. ..... 399/263

(58) Field of Classification Search ..... 399/260, 399/258, 267, 277, 263
See application file for complete search history.

(56) References Cited

U.S. PATENT DOCUMENTS

| | | | | |
|---|---|---|---|---|
| 3,233,587 | A * | 2/1966 | Morton | 399/277 |
| 5,744,772 | A | 4/1998 | Fasano | |
| 5,915,150 | A | 6/1999 | Kukimoto et al. | |
| 7,636,536 | B2 | 12/2009 | Iwata et al. | |
| 2001/0000743 | A1 * | 5/2001 | Yuasa et al. | |
| 2004/0019662 | A1 | 1/2004 | Viswanath et al. | |
| 2004/0191662 | A1 * | 9/2004 | Matsumura et al. | |
| 2005/0002699 | A1 * | 1/2005 | Tamura et al. | 399/258 |
| 2007/0053723 | A1 | 3/2007 | Iwata et al. | |

FOREIGN PATENT DOCUMENTS

| | | | |
|---|---|---|---|
| JP | 61-052665 | | 3/1986 |
| JP | 09-288373 | | 11/1997 |
| JP | 2000010451 | A * | 1/2000 |
| JP | 2002-162815 | | 6/2002 |
| JP | 2003-057929 | | 2/2003 |
| JP | 2006-106559 | | 4/2006 |
| JP | 2007-322721 | | 12/2006 |
| JP | 2007-102176 | | 4/2007 |

* cited by examiner

*Primary Examiner* — Susan Lee
(74) *Attorney, Agent, or Firm* — Renner, Otto, Boisselle & Sklar, LLP

(57) ABSTRACT

An image forming apparatus includes a photoreceptor drum, a charger, an exposure device, a developing device, a toner cartridge for supplying toner to the developing device, a transfer device and a fixing device. The toner cartridge includes: a toner container, a toner discharge port, a toner discharger having a toner agitator. The toner discharger includes a toner discharger rotary shaft, around which a helical magnet is provided; and magnetic particles that form a helical magnetic brush along the magnet on the surface of the toner discharger rotary shaft.

3 Claims, 7 Drawing Sheets

TONER CARTRIDGE AND IMAGE FORMING APPARATUS USING THE SAME

This Nonprovisional application claims priority under 35 U.S.C. §119(a) on Patent Application No. 2008-231120 filed in Japan on 9 Sep. 2008, the entire contents of which are hereby incorporated by reference.

BACKGROUND OF THE INVENTION (1) Field of the Invention

The present invention relates to a toner cartridge and an image forming apparatus using this, in particular, relating to a toner cartridge used for an image forming apparatus for forming images with toner, such as an electrostatic copier, laser printer, facsimile machine and the like, as well as relating to an image forming apparatus using this toner cartridge.

(2) Description of the Prior Art

Conventionally, in image forming apparatuses using static electrophotography such as copiers, facsimile machines, etc., that use toner, toner is supplied to a developing device by a toner supply device with a toner cartridge or the like to perform continuous printout of images.

The image forming apparatus of this kind usually includes the steps of charging, exposure, development, transfer, separation, cleaning, charge erasing and fixing.

For example, in the process for forming images, the surface of a photoreceptor drum that is rotationally driven is uniformly electrified by a charging device (charging step), and the photoreceptor drum surface thus electrified is illuminated with a laser beam from an exposure device to form an electrostatic latent image (exposure step). Subsequently, the electrostatic latent image on the photoreceptor drum is developed by a developing device to form a toner image on the photoreceptor drum surface (developing step).

The toner image on the photoreceptor drum is then transferred to a transfer medium by a transfer device (transfer step), thereafter the transferred toner image is heated and fused to the transfer medium by a fusing device (fixing step).

On the other hand, the residual toner remaining on the photoreceptor drum surface after transfer is removed by a cleaning device and collected into a predetermined collecting portion (cleaning step). The photoreceptor drum surface after cleaning is cleared of residual charge by a charge erasing device to prepare for a next image forming operation (charge erasing step).

As the developer for developing the electrostatic latent image on the photoreceptor drum, a mono-component developer consisting of a toner only or a dual-component developer consisting of a toner and a carrier is usually used.

Since the mono-component developer does not include any carrier, there is no need to have an agitating mechanism for mixing and uniforming toner and carrier. Hence this developing device has the advantage of a simple structure. However, there is a drawback that the amount of static charge on the toner is unlikely to be stable.

On the other hand, since the dual-component developer needs to have an agitating mechanism for mixing the toner and carrier uniformly, there is a drawback that the developing device becomes complex. However, since the developer presents stability in the amount of charge and excellent suitability to high-speed machines, it is often used for high-speed image forming apparatuses and color image forming apparatuses.

The system for dual-component developer is arranged such that toner is supplied from the toner cartridge into the developing device when toner is consumed from the dual-component developer, so that the concentration of the toner in the developer in the developing hopper will not be lower than a predetermined level.

Recently, in order to meet the user demands for energy saving and high-quality printout of images, micro-sized toners having a low softening temperature with a volume mean diameter as low as 5 to 9 μm have become used. Though the toner of this kind is designed to be fixable at a low fixing temperature and is effective in enhancing resolution and reducing granulation to achieve improved image quality, the toner suffers from the problem that its fluidity is low, hence the toner is prone to clump together inside the toner cartridge.

As an example of a countermeasure against this toner clumping problem, there has been disclosed a toner cartridge which is adapted to perform reverse rotation for a fixed period of time when a new toner cartridge is mounted to the image forming apparatus in order to bring away the toner remaining around the toner discharge port from the toner discharge port (see patent document 1: Japanese Patent Application Laid-open 2002-162815).

It is true that this conventional method makes it possible to loosen the toner that was compacted before attachment of the toner cartridge to the image forming apparatus due to vibration etc., during transportation of the toner cartridge, for example, but once the toner has been compacted due to the lowering of fluidity of the toner under a high-temperature environment while the image forming apparatus is in operation after the toner cartridge was attached to the image forming apparatus, this method is not useful, resulting in failure to prevent the toner discharging screw from being locked.

SUMMARY OF THE INVENTION

The present invention has been devised in view of the above conventional problem, it is therefore an object of the present invention to provide a toner cartridge in which toner will not be compacted after the toner cartridge was mounted into an image forming apparatus as well as to provide an image forming apparatus using this toner cartridge.

The toner cartridge according to the present invention to solve the above problem and the image forming apparatus using this are configured as follows:—

The toner cartridge according to the first aspect of the present invention includes: a toner storing portion for storing toner; a toner discharge port for discharging the toner in the toner storing portion from the toner storing portion; and, a toner discharger for conveying the toner in the toner storing portion toward the toner discharge port by rotation thereof, and is characterized in that the toner discharger includes a toner discharger rotary shaft for rotating the toner discharger, the toner discharger rotary shaft has a magnet helically arranged about the axis thereof, and magnetic particles forming a helical magnetic brush along the magnet on the surface of the toner discharger rotary shaft.

The toner cartridge according to the second aspect of the present invention is characterized in that the magnet is embedded on the surface of the toner discharger rotary shaft.

The toner cartridge according to the third aspect of the present invention is characterized in that the magnetic field formed by the magnet is specified such that the component of the maximum magnetic flux density on the magnet surface in the direction normal to the toner discharger rotary shaft surface (in the radial direction of the toner discharger rotary shaft) falls within the range from 100 mT to 200 mT.

The toner cartridge according to the fourth aspect of the present invention is characterized in that the magnetic particles include ferrite.

The toner cartridge according to the fifth aspect of the present invention is characterized in that the magnetic particles are spherical magnetic particles having a mean volume diameter of 80 μm to 200 μm.

The toner cartridge according to the sixth aspect of the present invention is characterized in that the saturation magnetism of the magnetic particles falls within the range of 60 emu/g to 200 emu/g.

The toner cartridge according to the seventh aspect of the present invention is characterized in that the magnetic particles have a coating layer on the surface thereof.

The toner cartridge according to the eighth aspect of the present invention is characterized in that the coating layer includes a conductive agent.

The toner cartridge according to the ninth aspect of the present invention is characterized in that the toner storing portion holds spare magnetic particles to be added to.

The image forming apparatus according to the tenth aspect of the present invention resides in an image forming apparatus for forming images with toner based on electrophotography, comprising: a photoreceptor drum for forming an electrostatic latent image on the surface thereof; a charger for electrifying the photoreceptor drum surface; an exposure device for forming the electrostatic latent image on the photoreceptor drum surface; a developing device for forming a toner image by supplying toner to the electrostatic latent image on the photoreceptor drum surface; a toner cartridge for supplying the toner to the developing device; a transfer device for transferring the toner image on the photoreceptor drum surface to a recording medium; and a fusing device for fixing the toner image on the recording medium, being characterized in that the toner cartridge employs anyone of the toner cartridges defined in the above first to ninth aspects.

According to the first aspect of the present invention, since a flexible magnetic brush is used as the toner conveying blade, the maximum pressure acting on the toner is alleviated so that it is possible to prevent the toner discharger from being locked due to compactness of the toner being compressed. As a result, it is possible to perform stable toner supply and hence produce stable images over a long period of time.

According to the second aspect of the present invention, since the toner is conveyed without receiving direct force from the magnet, it is possible to prevent the toner from being compacted even if toner fluidity is lowered.

According to the third aspect of the present invention, since the magnetic particles can be retained without falling off and formed into a soft magnetic brush, it is possible to prevent the toner from being damaged by strong frictional force.

According to the fourth aspect of the present invention, since a steady magnetic brush is formed, it is possible to improve toner conveying force.

According to the fifth aspect of the present invention, it is possible to prevent the magnetic particles from being blended with toner and discharged out of the toner cartridge as well as to prevent reduction of the capability of conveying toner that is adhering on the interior wall of the toner cartridge.

According to the sixth aspect of the present invention, it is possible to suppress damage to the toner due to excessively strong frictional force and prevent the magnetic particles from being blended into the toner and discharged to the outside of the toner cartridge.

According to the seventh aspect of the present invention, it is possible to improve anti-soil deposition performance and wear-resistance of the magnetic particles.

According to the eighth aspect of the present invention, since frictional electrification between the toner and the magnetic particles can be reduced, it is possible to prevent the magnetic particles from being mixed up with the toner.

According to the ninth aspect of the present invention, since it is possible to supply magnetic particles even if part of the magnetic particles falls off from the toner discharger, the brushing effect of the magnetic particles will not be lowered.

According to the tenth aspect of the present invention, since it is possible to prevent the toner discharger from being locked and hence perform stable toner supply, stable images can be obtained over a long period of time.

DESCRIPTION OF THE PREFERRED EMBODIMENTS

The best mode for carrying out the present invention will hereinafter be described with reference to the drawings.

Figure 1:
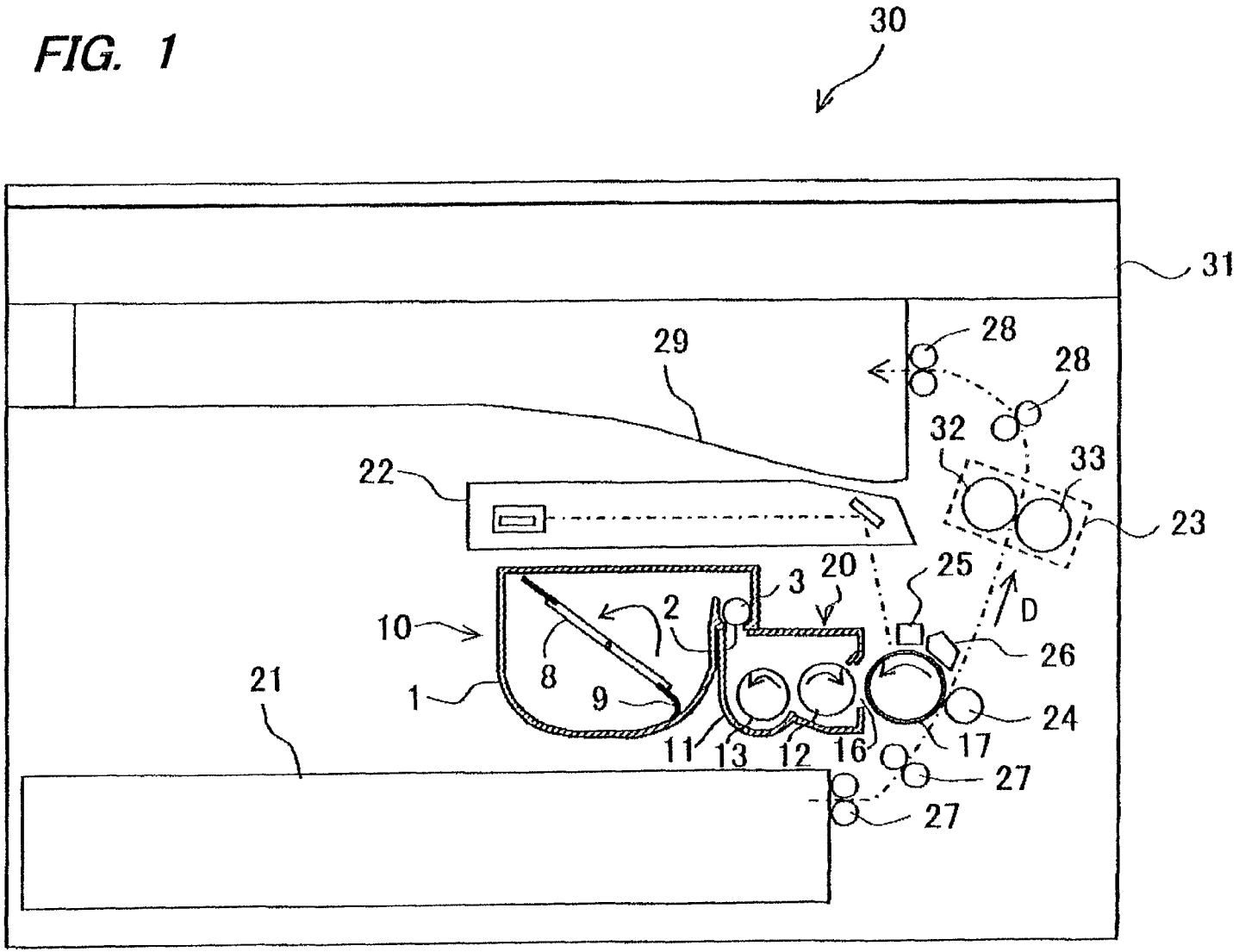
FIG. 1 is an illustrative view showing an embodied configuration of an image forming apparatus using a toner cartridge according to the present invention.
Figure 2:
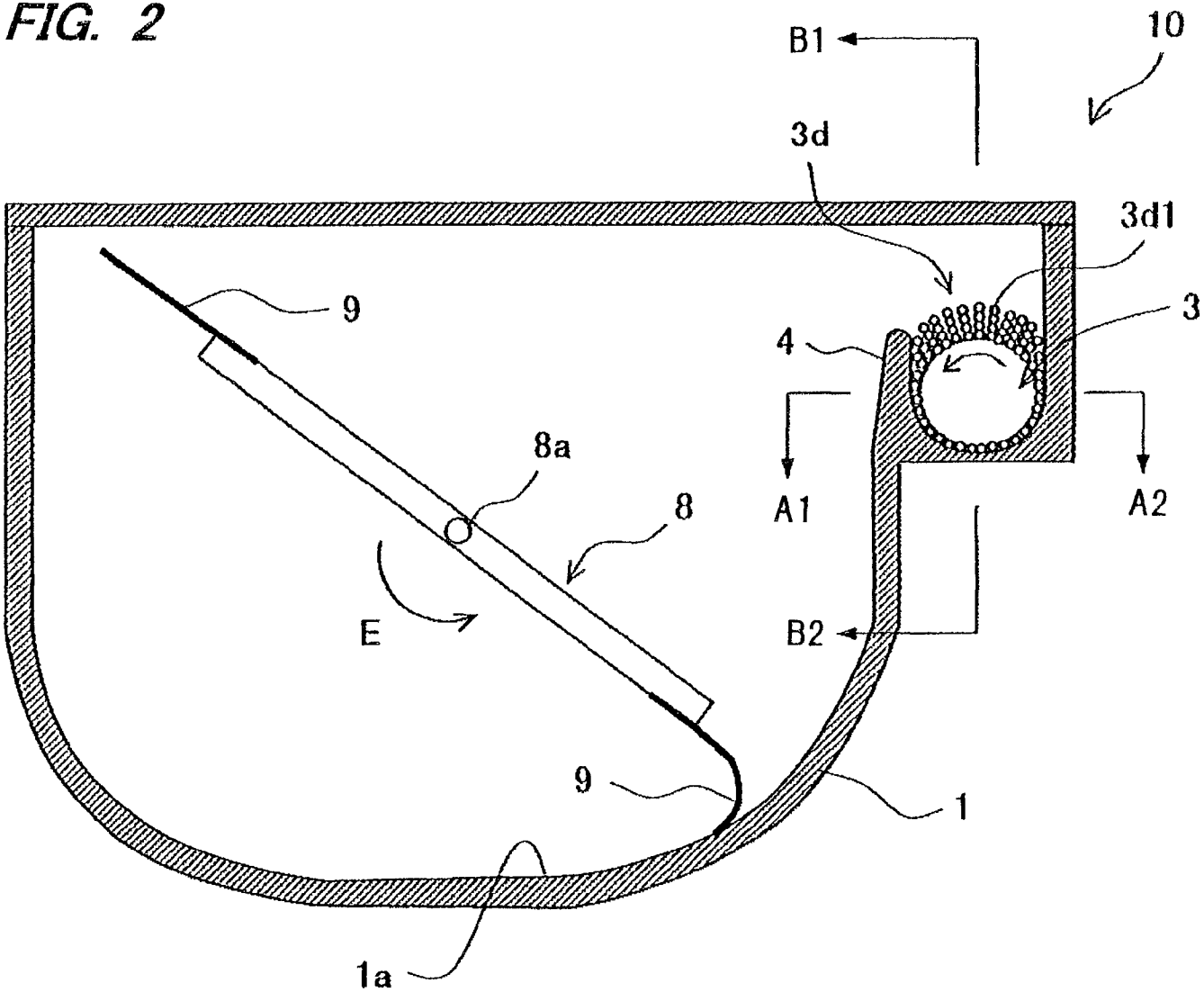
FIG. 2 is a front sectional view showing a configuration of a toner cartridge that constitutes the image forming apparatus.
Figure 3:
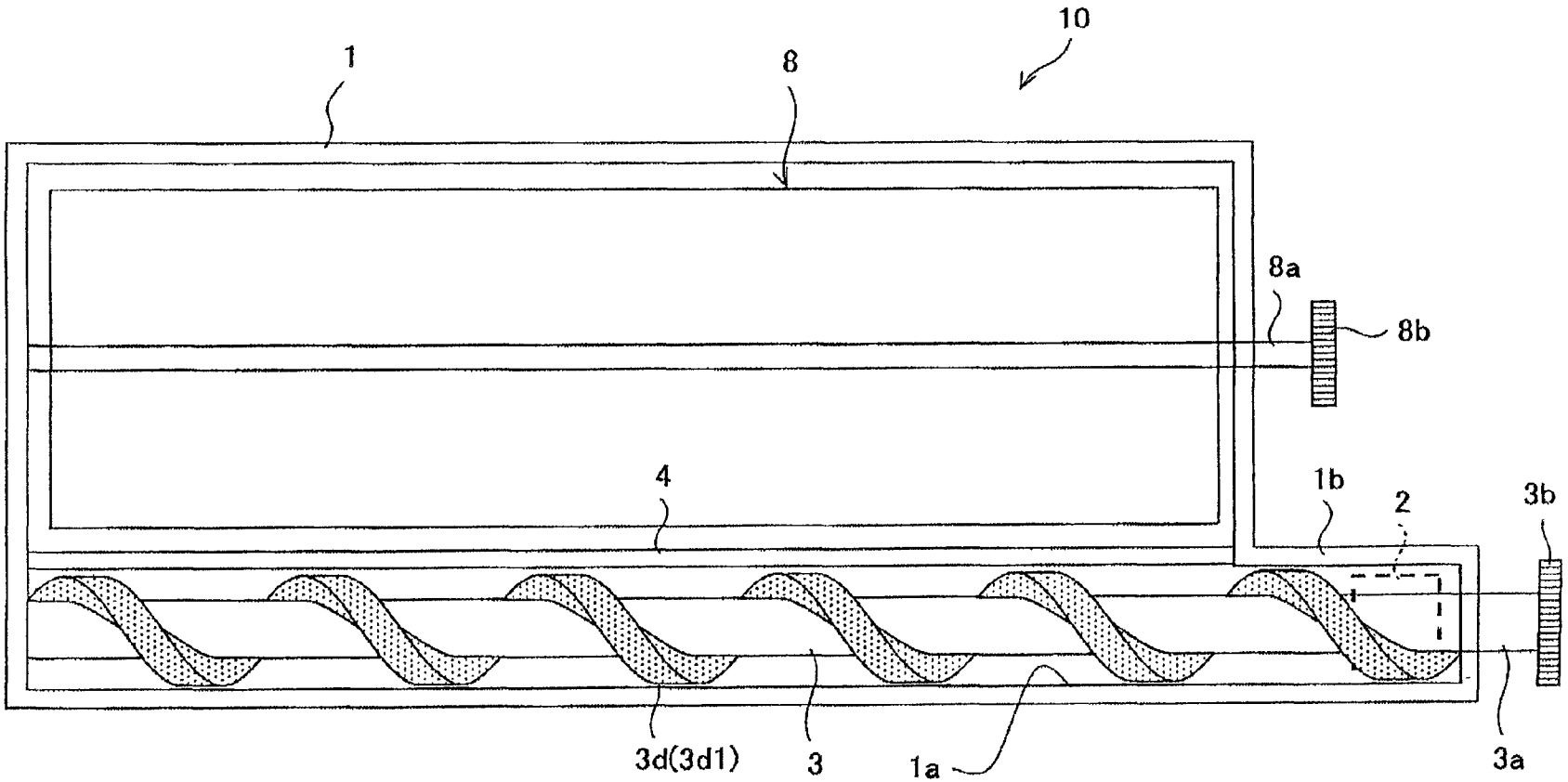
FIG. 3 is a top view showing the toner cartridge with its top cover removed.
Figure 4:
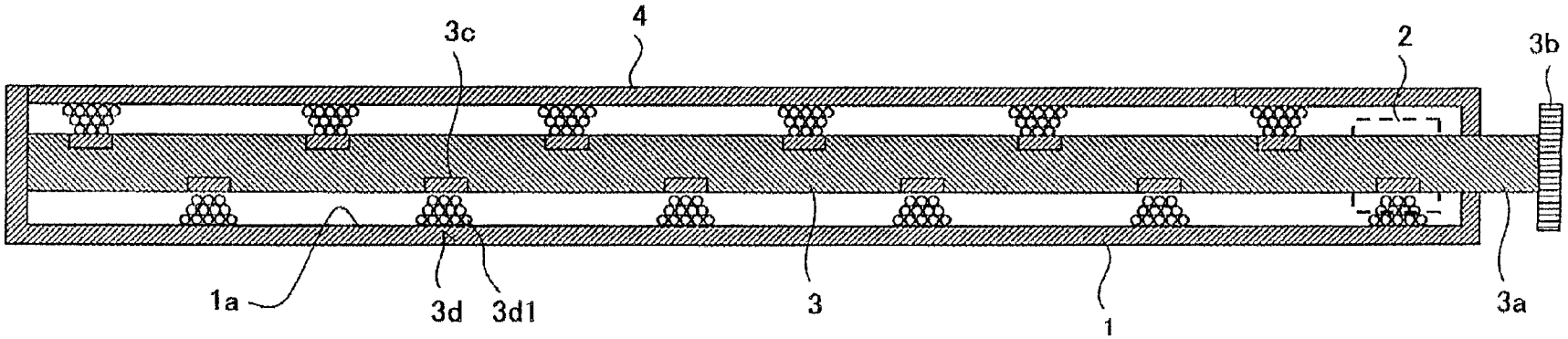
FIG. 4 is a sectional view, cut along planes A1-A2 in FIG. 2.
Figure 5:
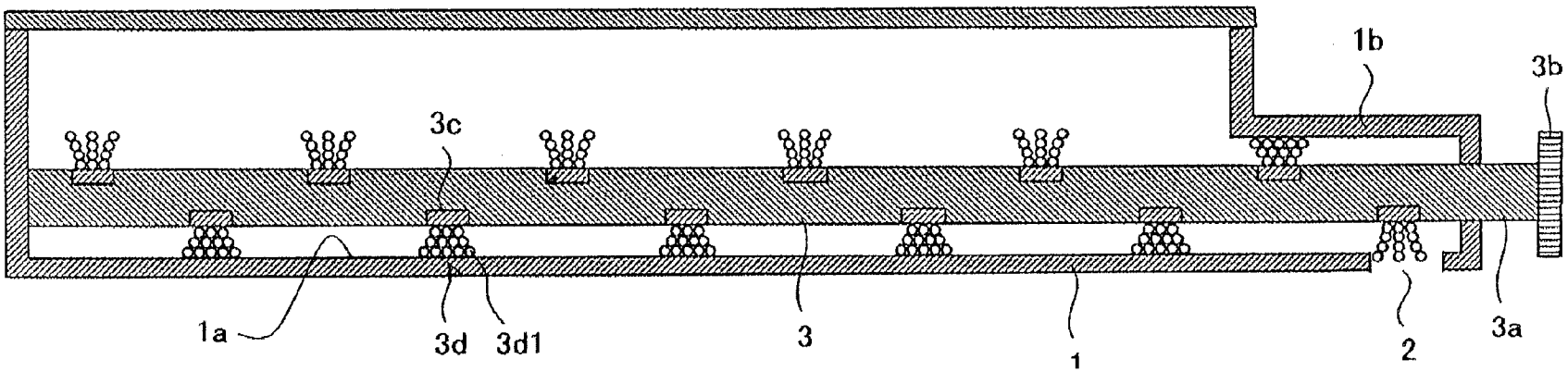
FIG. 5 is a sectional view, cut along a plane B1-B2 in FIG. 2.

FIG. 1 is an illustrative view of one exemplary embodiment of the present invention, showing an overall configuration of an image forming apparatus using a toner cartridge according to the present invention. FIG. 2 is a front sectional view showing a configuration of a toner cartridge that constitutes the image forming apparatus. FIG. 3 is a top view showing the toner cartridge with its top cover removed. FIG. 4 is a sectional view, cut along planes A1-A2 in FIG. 2. FIG. 5 is a sectional view, cut along a plane B1-B2 in FIG. 2.

An image forming apparatus 30 of the present embodiment includes: as shown in FIG. 1, a photoreceptor drum 17 on the surface of which an electrostatic latent image is formed; a charger 25 for electrifying the photoreceptor drum 17 surface; an exposure device 22 for forming an electrostatic latent image on the photoreceptor drum 17 surface; a developing device 20 for supplying toner to the photoreceptor drum 17 surface to develop the electrostatic latent image into a toner image; and a toner cartridge 10 for supplying toner to developing device 20, and visualizes the electrostatic latent image formed on photoreceptor drum 17 as a toner image, based on electrophotography.

As shown in FIG. 2, toner cartridge 10 according to the present embodiment includes a toner discharger 3 that rotates to discharge toner from a toner container (toner storing portion) 1 to the outside thereof; and a toner agitator 8 for agitating toner inside toner container 1, and is constructed so as to be detachably attached to developing device 20 that is mounted in image forming apparatus 30.

To begin with the overall configuration of image forming apparatus 30 will be described.

As shown in FIG. 1, image forming apparatus 30 according to the present embodiment, includes toner cartridge 10, developing device 20, photoreceptor drum 17, charger 25, exposure device 22, a cleaning device 26, a transfer device 24, a fusing device 23, a paper feed cassette 21, a paper output tray 29 and a scanner unit 31.

Photoreceptor drum 17 is a roller-like member, which is axially supported and rotationally driven by an unillustrated driver and on the surface of which an electrostatic latent image, and hence its toner image is formed. As photoreceptor drum 17, a roller-shaped member of an unillustrated conductive base on which a photo-sensitive layer is concentrically formed thereon may be used, for example.

As the conductive base, conductive bases in cylindrical, columnar, sheet-like and other forms may be used. Of these, a cylindrical conductive base is preferable.

As the photo-sensitive layer, an organic photo-sensitive layer, inorganic photo-sensitive layer and the like may be listed.

The organic photo-sensitive layer may be given as a lamination-type photoreceptor in which a charge generating layer of a resin coating containing a charge generating substance and a charge transport layer of a resin coating containing a charge transport substance are laminated, or may be given as a mono-layered photoreceptor in which a single resin coating contains both a charge generating substance and a charge transport substance.

The inorganic photo-sensitive layer may be given as a film coating containing one, or two or more kinds of substances selected from zinc oxide, selenium, amorphous silicon and the like.

Inserted between the conductive base and the photo-sensitive layer may be a primer coating. A surface coating (protective coating) for principally protecting the photo-sensitive layer can be formed on the surface of the photo-sensitive layer.

Charger 25 is to perform corona discharge over photoreceptor drum 17, and employs a saw-toothed charger. Other than the saw-toothed charger, a charger type electrifier, a charging brush type charger, a roller-type charger, a magnetic brush and other contact type chargers may be used as this charger 25.

An unillustrated power supply is connected to charger 25 so as to apply voltage to charger 25. That is, charger 25 receives voltage application from the power supply and electrifies the photoreceptor drum 17 surface at a predetermined voltage of a predetermined polarity.

Exposure device 22 receives input of image data of originals read by scanner unit 31 or input of image data from an external device, and irradiates the photoreceptor drum 17 surface having been electrostatically electrified, with signal light in accordance with the image data. By this process, an electrostatic latent image corresponding to the image data is formed on the photoreceptor drum 17 surface. As this exposure device 22, a laser scanning system including a light source is used.

The laser scanning system is a unit that includes, for example a light source, a polygon mirror, an f-θ lens, reflection mirrors and other elements. As the light source, a semiconductor laser, LED array, electro luminescence (EL) device and the like can be used.

Developing device 20 includes toner cartridge 10, a developing hopper 11, an agitating roller 13 and a developing roller 12.

Developing hopper 11 is a receptacle that has an approximately semi-cylindrical configuration having an interior space, rotatably supporting agitating roller 13 and developing roller 12 and storing a dual-component developer (which will be referred to hereinbelow as merely the "developer") made of a toner and a carrier.

Agitating roller 13 is rotationally driven by an unillustrated driver to agitate the developer stored in developing hopper 11.

Developing roller 12 is a roller-shaped member that conveys the developer to photoreceptor drum 17 and is rotationally driven about its axis by an unillustrated driver. Developing roller 12 is arranged opposing photoreceptor drum 17 through opening 16 of developing hopper 11 with a predetermined gap apart from photoreceptor drum 17.

The developer conveyed by developing roller 12 comes in contact with photoreceptor drum 17 in the area where developing roller 12 approaches most closely to photoreceptor drum 17. This contact area forms the developing nip. A developing bias voltage is applied to developing roller 12 from an unillustrated power supply connected to developing roller 12 so that toner is supplied from the developer on the developing roller 12 surface to the electrostatic latent image on the photoreceptor drum 17 surface through the developing nip.

An unillustrated toner concentration detecting sensor is provided at the bottom of developing hopper 11 vertically below agitating roller 13 so that the sensor surface is exposed to the interior of developing hopper 11.

The toner concentration detecting sensor is electrically connected to an unillustrated controller. When the detected result from the toner concentration detecting sensor is determined to be lower than a set toner concentration level, the controller sends a control signal to the driver for rotationally driving toner discharger 3 so as to rotationally drive toner discharger 3.

Transfer device 24 is a roller-shaped member that is rotatably supported by an unillustrated supporting structure and arranged in press-contact with photoreceptor drum 17 so as to be rotationally driven by an unillustrated drive means.

As transfer device 24, a roller-shaped member formed of a metal core having a diameter of, for example 8 to 10 mm and an elastic conductive layer concentrically formed on the surface of the metal core is used. As the metal forming the metal core, stainless steel, aluminum or the like may be used. As the elastic conductive layer, rubber material, such as ethylene-propylene rubber (EPDM), foamed EPDM, foamed urethane, etc., in which a conductive substance such as carbon black etc. is blended, can be used.

Recording medium is fed, one sheet at a time, from paper feed cassette 21 by a paper feed roller 27 into the press-contact portion (transfer nip portion) between photoreceptor drum 17 and transfer device 24 in synchronization with the toner image that is conveyed by rotation of photoreceptor drum 17.

As the recording medium passes through the transfer nip portion between photoreceptor drum 17 and transfer device 24, the toner image on the photoreceptor drum 17 surface is transferred to the recording medium.

An unillustrated power supply is connected to transfer device 24 so as to apply voltage of an opposite polarity to that of static charge on the toner that forms the toner image, to transfer device 24 when the toner image is transferred to the recording medium. Thereby, the toner image is smoothly transferred to the recording medium.

Cleaning device 26 includes an unillustrated cleaning blade and an unillustrated toner storing vessel. The cleaning blade is a plate-like member that extends parallel to the axial direction of photoreceptor drum 17 and is arranged so as to abut one side along the longitudinal direction against the photoreceptor drum 17 surface This cleaning blade abuts the surface of rotating photoreceptor drum 17 to thereby remove toner, paper particles and the like that remain on the photoreceptor drum 17 surface after transfer of the toner image to the recording medium, from the photoreceptor drum 17 surface. The toner removed by the cleaning blade is temporarily stored in an unillustrated toner storing vessel that is given as a container-like member having a hollow space therein. The thus constructed cleaning unit 26 cleans the photoreceptor drum 17 surface after toner image transfer.

Fusing device 23 includes a fusing roller 32 and pressing roller 33.

Fusing roller 32 is a roller-shaped member that is rotatably supported by an unillustrated structure and can be axially rotated by an unillustrated driver. This fusing roller 32 has an unillustrated heating element therein to heat and fuse the toner that forms the unfixed toner image carried on the recording medium being conveyed from the transfer nip portion, to thereby fix the image to the recording medium.

As fusing roller 32, a roller-shaped member formed of, for example, a metal core and an elastic layer provided concentrically thereon is used. The metal core may be formed of metal such as iron, stainless steel, aluminum or the like. The elastic layer may be formed of an elastic material such as silicone rubber, fluoro rubber, etc. The heating element generates heat as it is supplied with voltage from an unillustrated power supply. The heating element may use a halogen lamp, infrared lamp or the like.

Pressing roller 33 is a roller-shaped member that is rotatably supported and pressed against fusing roller 32 by an unillustrated pressing member. This pressing roller 33 is driven to rotate following the rotation of fusing roller 32. The press-contact portion between fusing roller 32 and pressing roller 33 forms the fixing nip portion.

Pressing roller 33 promotes the fixing of the toner image to the recording medium by pressing the melting toner to the recording medium when the toner image is heated and fixed to the recording medium by fusing roller 32. Pressing roller 33 may use a roller-shaped member having the same configuration as fusing roller 32. Pressing roller 33 may also include a heating element therein. As this heating element the same one inside fusing roller 32 may be used.

In fusing device 23, when the recording medium with a toner image transferred thereon is passed through the fixing nip portion, the toner that forms the toner image is fused and pressed to the recording medium so that the toner image is fixed to the recording medium. The recording medium with the image (toner image) printed thereon is discharged to paper output tray 29 by means of a paper output roller 28. The arrow designated at D in FIG. 1 shows the recording medium's direction of conveyance.

Paper feed cassette 21 is a tray for holding recording media such as plain paper, coated paper, color copy paper, OHP film sheets and the like. An unillustrated pickup roller and conveying rollers feed recording media, one sheet at a time, to the transfer nip portion in synchronization with conveyance of the toner image on the photoreceptor drum 17 surface.

Scanner unit 31 is equipped with an unillustrated document set tray, a reversing automatic document feeder (RADF) and the like and also includes an unillustrated document reading device.

The automatic document feeder feeds originals set on the document set tray to the original table of the document reading device. The document reading device includes the original table, a document scanner, reflecting components and a line sensor of a photoelectric transducer (charge coupled device, which will be referred to hereinbelow as 'CCD'), so as to read the image data of the original placed on the original table every multiple lines, for example, every ten lines.

The original table is formed of a glass plate member on which an original is placed to read image data therefrom.

The document scanner, including an unillustrated light source and a first reflecting mirror, moves along, and parallel to, the vertical underside of the original table at a fixed speed V in a reciprocating manner so as to illuminate the image surface of the document placed on the original table with light. A reflected light image can be obtained by this light illumination.

The light source is a light source for the light to be irradiated on the original placed on the original table.

The first reflecting mirror reflects the reflected light image to a reflecting assembly.

This reflecting assembly includes unillustrated second and third reflecting mirrors and an optical lens to focus the reflected light image obtained by the document scanner onto the CCD line sensor. The reflecting assembly reciprocates at a speed of V/2 following the reciprocating movement (at a moving speed of V) of the document scanner.

The second and third reflecting mirrors reflect the reflected light image toward the optical lens. The optical lens focuses the reflected light image on to the CCD line sensor. The CCD line sensor includes an unillustrated CCD circuit for photoelectrically converting the reflected light image focused by the optical lens into electric signals and outputs the electric signals carrying the image data to the image processor in the controller.

The image processor converts the image data supplied from the document reading device or an external device such as a personal computer or the like into electric signals, which are output to exposure device 22.

Next, toner cartridge 10 will be described in detail with reference to the drawings.

As shown in FIGS. 1 and 2, toner cartridge 10 includes toner container 1, toner discharge port 2, toner discharger 3, a toner agitator 8 and toner scooping blades 9 and supplies toner to developing device 20.

Toner container 1 is an approximately semi-cylindrical container member having an interior space to hold toner therein and supports toner agitator 8 and toner discharger 3 in a rotatable manner.

Also, as shown in FIGS. 3 and 5, toner container 1 is formed such that its one end with respect to the axial direction of toner discharger 3 is projected forming a projected portion 1*b* and a toner discharge port 2 of a rectangular opening is formed in projected portion 1*b*, vertically under toner discharger 3.

As shown in FIG. 1, toner discharge port 2 is disposed at the position opposing developing device 20 of image forming apparatus 30 when toner cartridge 10 is mounted to image forming apparatus 30.

Toner agitator 8 is integrally formed with a rotary shaft 8*a* (FIG. 3), an agitation gear 8*b* (FIG. 3) and toner scooping blades 9, and rotates about rotary shaft 8*a* to agitate the toner stored in toner container 1 as drive force is transferred through agitation gear 8*b*.

Toner agitator 8 is driven to rotate by driving force transferred through an unillustrated gear transmission mechanism and drive motor.

Toner scooping blades 9 are formed of a flexible polyethylene terephthalate (PET) sheet of about 0.5 to 2 mm thick and scoops up toner in toner container 1 and conveys it to toner discharger 3. Toner scooping blades 9 are attached to both the toner agitator 8's longitudinal sides that lie in the direction in which toner discharger 3 extends (in the axial direction).

As shown in FIGS. 3 to 5, toner discharger 3 includes a toner discharger rotary shaft 3*a*, a discharger drive gear 3*b* and magnetic particles 3*d*1 (functioning as a toner conveyor) that form a magnetic brush 3*d*. Details of magnetic particles 3*d*1 will be described later.

As shown in FIG. 1, toner discharger 3 supplies toner that has been conveyed by toner scooping blades 9 to developing hopper 11 through toner discharge port 2.

Provided between toner discharger 3 and toner agitator 8 is a toner discharger partition (partitioning portion) 4 that separates the interior space of toner container 1 into two compartments on the toner discharger 3 side and on the toner agitator 8 side along the axial direction of toner discharger 3 as shown in FIG. 3. This toner discharger partition 4 enables a suitable amount of toner to be scooped up by toner agitator 8 and held around toner discharger 3.

Next, the configuration of toner discharger rotary shaft 3*a* will be specifically described.

Figure 6:
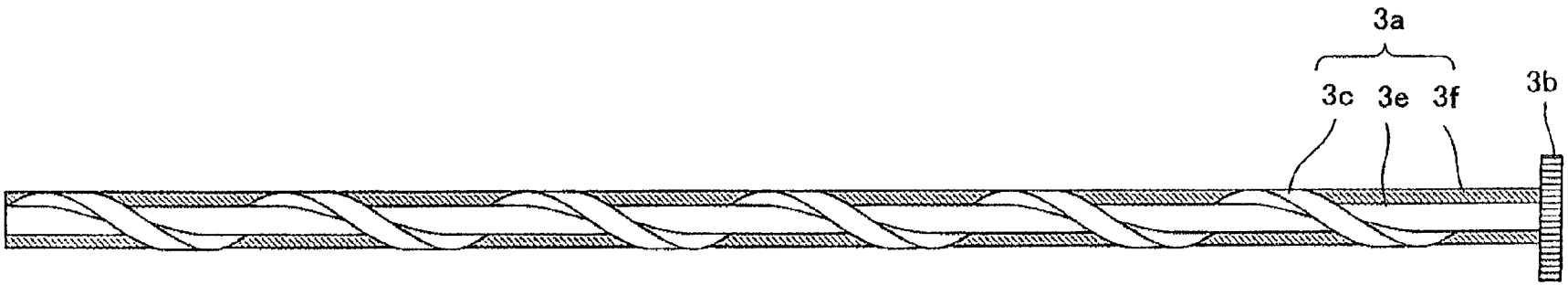
FIG. 6 is a schematic view showing a configuration of a toner discharger rotary shaft of the present embodiment; and, FIG. 7 is a sectional view showing the configuration of the toner discharger rotary shaft.
Figure 7:
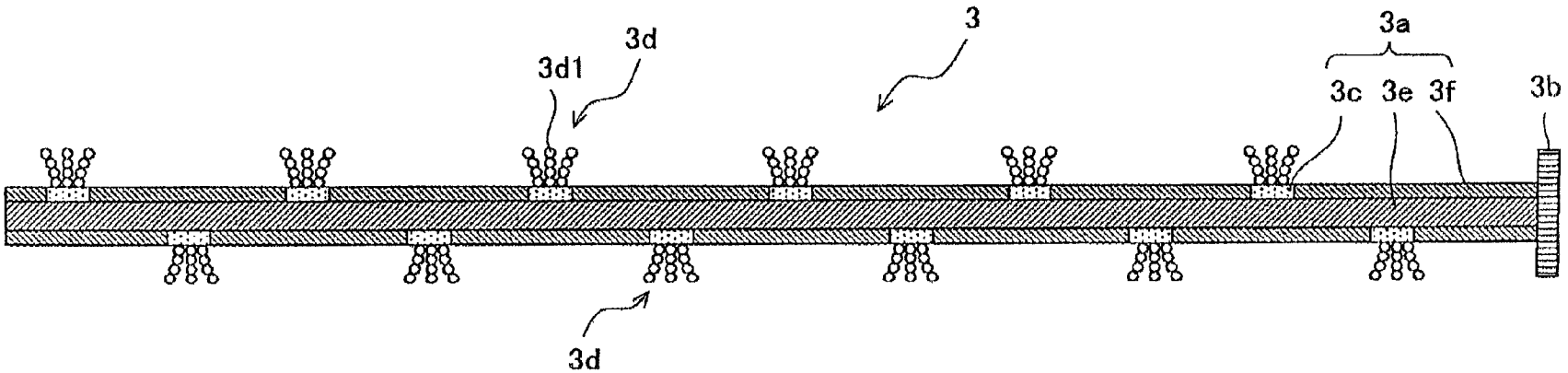

FIG. 6 is a schematic view showing the configuration of a toner discharger rotary shaft of the present embodiment. FIG. 7 is a sectional view showing the configuration of the toner discharger rotary shaft.

As shown in FIG. 6, toner discharger rotary shaft 3*a* is a cylindrical member formed of a rotary shaft core 3*e* made of non-magnetic stainless steel, a magnet 3*c* helically formed around rotary shaft core 3*e* and a toner discharger protecting layer 3*f*. Magnet 3*c* uses a permanent magnet.

The magnetic field formed by magnet 3*c* is preferably specified such that the component of the maximum magnetic flux density on the magnet 3*c* surface in the direction normal to the toner discharger rotary shaft 3*a* surface or in the radial direction of toner discharger rotary shaft 3*a* falls within the range from 100 mT to 200 mT. That is, when the magnetic flux density of magnet 3*c* is less than 100 mT, it is difficult to retain magnetic particles 3*d*1, hence the particles are prone to leave. On the other hand, when the magnetic flux density of magnet 3*c* exceeds 200 mT, magnetic brush 3*d* becomes so stiff that the frictional force is enhanced causing great damage to the toner.

As shown in FIG. 7, toner discharger 3 has magnetic particles 3*d*1 attracted to magnet 3*c* provided for toner discharger rotary shaft 3*a* to constitute magnetic brush 3*d* (functioning as the toner conveyor), and is rotated by the drive force that is transferred from an unillustrated drive motor by way of discharger drive gear 3*b*.

Since magnet 3*c* is provided in a helical configuration along the outer peripheral side of toner discharger 3, magnetic brush 3*d* is also formed in a helical form along the peripheral side of toner discharger 3. The handedness of the helix of magnetic brush 3*d* is set so that toner will be conveyed from one end of toner discharger 3 to the toner discharge port 2 side.

It is preferred that magnetic brush 3*d* is so formed that its distal part comes into contact with the interior wall, designated at 1*a*, of toner cartridge 10 without leaving any gap, as shown in FIGS. 4 and 5. This not only improves conveyance efficiency of toner but also can reduce the residual amount of the toner that is not discharged but remains inside toner cartridge 10.

Now, magnetic particle 3*d*1 will be described.

As magnetic particle 3*d*1, publicly know magnetic particles can be used, but spherical particles (ferrite particles) including ferrite, having a mean volume diameter of 80 μm to 200 μm are preferably used.

Since the ferrite particles are high in saturation magnetization, it is possible to yield strong force for toner conveyance. Also, use of spherical ferrite particles improves fluidity and durability. That is, when the volume mean diameter is less than 80 μm, the contact area with the toner becomes so large that magnetic participles 3*d*1 tend to be mingled with toner and become easily discharged from toner cartridge 10. On the other hand, when the volume mean diameter exceeds 200 μm, the surface of magnetic brush 3*d* becomes coarse so that the capability of conveying the toner that is adhering on interior wall 1*a* of toner cartridge 10 lowers.

When the saturation magnetism of magnetic particles 3*d*1 is too high, magnetic brush 3*d* becomes stiffened so that its rubbing force becomes so strong as to cause damage to the toner. When the saturation magnetism of magnetic particles 3*d*1 is too low, the particles tend to be blended into the toner and become easily discharged from toner cartridge 10. Accordingly, the saturation magnetism of magnetic particles 3*d*1 is preferably specified to fall within the range of 60 to 200 emu/g. Here in the present embodiment, the saturation magnetism is the value that is measured by VSMP-1 manufactured by TOEI INDUSTRY CO. LTD.

As the ferrite particle, publicly known products can be used. For example, particles of zinc ferrite, nickel ferrite, copper ferrite, nickel zinc ferrite, manganese magnesium ferrite, copper magnesium ferrite, manganese zinc ferrite, manganese copper zinc ferrite and the like can be listed.

These ferrite particles can be manufactured by publicly known methods. For example, ferrite raw materials such as $Fe_2O_3$, $Mg(OH)_2$ and the like are blended and the mixed powder is calcined in a heating furnace. The resultant calcined product is cooled and pulverized by a vibration mill into particles having a size of about 1 μm, then a dispersing agent and water is added to the pulverized powder to prepare slurry. This slurry is wet pulverized by a wet ball mill, and the resultant suspension is granulated and dried to thereby obtain the ferrite particles.

The ferrite particles can be used as they are, but in order to improve anti-soil deposition performance and wear-resistance, a resin may be coated on the surface of the ferrite particles. As the coating material, silicone resin, acrylic resin, fluoro resin can be used. Of these, fluoro resin is preferable in view of its excellence in anti-soil deposition performance of the magnetic particle surface. When a toner bearing negative charge is used, it is possible to prevent magnetic particles 3*d*1 from being blended into the toner and hence being discharged from the toner cartridge because electrostatic attraction between the toner and the fluororesin which present negative charge performance becomes weak.

Further, addition of conductive agents to the resin that coats magnetic particles 3*d*1 is preferable.

Inclusion of conductive agents in the resin layer (coating layer) makes it possible to alleviate frictional electrification between the resin layer and the toner, hence it is possible to prevent the toner from being mixed with magnetic particles 3*d*1.

As the conductive agent, any material can be used as long as it can control the volume resistivity of magnetic particles 3*d*1. Examples of the conductive agents include silicon oxide, alumina, carbon black, graphite, zinc oxide, titanium black, iron oxide, titanium oxide, tin oxide, potassium titanate, calcium titanate, aluminum borate, magnesium oxide, barium sulfate, calcium carbonate and others. A single kind of conductive agent may be used or two or more kinds may be used in combination.

Of these conductive agents, carbon black is preferable in view of manufacturing stability, cost and low electric resistance. The type of carbon black is not particularly limited, but a carbon black having a DBP (dibutyl phthalate) oil absorption of 90 to 170 ml/100 g is preferable since it shows excellent manufacturing stability. Further, carbon black having a primary diameter of 50 nm or below is particularly preferable since it is excellent in dispersibility.

As to the content of the conductive agents in the resin layer, 1 to 20 parts by weight of conductive agents is blended to 100 parts by weight of the resin for forming the resin layer. If the content of conductive agents in the resin layer is less than one part by weight, conductivity may fail to be obtained. On the other hand, if the content of conductive agents in the resin layer exceeds 20 parts by weight, the resin layer is prone to peel.

For forming the coating layer of magnetic particles 3*d*1, publicly known methods can be used. For example, the raw material of the coating layer is dissolved into a solvent (organic solvent such as toluene, acetone or the like). Then, the core particles may be dipped into the obtained solution (the dipping method). Alternatively, the solution may be applied or sprayed over the core particles.

Further, since toner container 1 holds spare magnetic particles for magnetic particles 3*d*1, it is possible to supply magnetic particles 3*d*1 if they have fallen off from toner discharger 3. Accordingly, there is no fear of the brushing effect of magnetic particles 3*d*1 being lowered.

Next, the operation of supplying toner from toner cartridge 10 to developing device 20 in image forming apparatus 30 of the present embodiment will be described.

When toner is supplied from toner cartridge 10 to developing device 20, in toner cartridge 10 toner agitator 8 is rotated in the direction of arrow E as shown in FIG. 2 so as to scoop up toner by scooping blades 9 towards the toner discharger 3 side while agitating the toner inside toner container 1.

At this time, toner scooping blades 9 rotate as they are deforming and sliding over inner wall 1*a* of toner container 1 due to the flexibility of the material that forms the blades, whereby the toner on the downstream side with respect to the rotational direction, or the toner residing on the right side (close to developing device 20 in FIG. 2) in toner container 1 and over the toner scooping blade 9 in FIG. 2, is supplied to the toner discharger 3 side.

Then, the toner supplied to the toner discharger 3 side is conveyed toward toner discharge port 2 by magnetic brush 3*d* helically formed of magnetic particles 3*d*1 as toner discharger 3 rotates as shown in FIG. 3, and supplied to developing device 20 through toner discharge port 2 as shown in FIG. 1.

According to the present embodiment thus constructed, since toner discharger 3 is constructed of toner discharger rotary shaft 3*a* having magnet 3*c* helically formed around the axis thereof and magnetic particles 3*d*1 that form magnetic brush 3*d*, it is possible to convey the toner by using the toner conveyor blade that is formed of flexible magnetic brush 3*d*. Accordingly, the maximum pressure acting on the toner can be alleviated, hence it is possible to prevent toner discharger 3 from being locked due to compactness of the toner being compressed.

As a result, according to the image forming apparatus 30 of the present embodiment, since it is possible with toner cartridge 10 to carry out stable toner supply to developing device 20, highly qualified images can be produced in a stable manner.

Though the above embodiment was described taking the example in which toner cartridge 10 is applied to image forming apparatus 30 shown in FIG. 1, as long as it is an image forming apparatus in which toner is supplied to a developing device using toner cartridge 10, the invention can be developed to any other image forming apparatus and the like, not limited to the image forming apparatus or copier having the configuration described above.

Having described heretofore, the present invention is not limited to the above embodiment, and various changes can be made within the scope of the appended claims. That is, any embodied mode obtained by combination of technical means modified as appropriate without departing from the spirit and scope of the present invention should be included in the technical art of the present invention.

What is claimed is:

1. A toner cartridge comprising:

a toner storing portion for storing toner;

a toner discharge port for discharging the toner in the toner storing portion from the toner storing portion; and, a toner discharger for conveying the toner in the toner storing portion toward the toner discharge port by rotation thereof, wherein the toner is for a dual-component developer made of a toner and a magnetic particle, characterized in that the toner discharger includes a toner discharger rotary shaft, made of a non-magnetic material, for rotating the toner discharger, the toner discharger rotary shaft has a magnet helically arranged about the axis thereof, and magnetic particles forming a helical magnetic brush along the magnet on the surface of the toner discharger rotary shaft.

2. The toner cartridge according to claim 1, wherein the magnetic particles are ferrite particles including ferrite, wherein a surface thereof is coated with a fluro resin and a negative charge bearing toner is used.

3. An image forming apparatus for forming images with toner based on electrophotography, comprising:

a photoreceptor drum for forming an electrostatic latent image on the surface thereof;

a charger for electrifying the photoreceptor drum surface;

an exposure device for forming the electrostatic latent image on the photoreceptor drum surface;

a developing device for forming a toner image by supplying toner to the electrostatic latent image on the photoreceptor drum surface;

a toner cartridge for supplying the toner to the developing device;

a transfer device for transferring the toner image on the photoreceptor drum surface to a recording medium; and a fusing device for fixing the toner image on the recording medium, characterized in that the toner cartridge employs the toner cartridge defined in claim 1.

* * * * *